US007481623B1

(12) United States Patent
Liang

(10) Patent No.: US 7,481,623 B1
(45) Date of Patent: Jan. 27, 2009

(54) COMPARTMENT COOLED TURBINE BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 376 days.

(21) Appl. No.: 11/503,547

(22) Filed: Aug. 11, 2006

(51) Int. Cl.
*F01D 5/18* (2006.01)

(52) U.S. Cl. ..... 416/97 R

(58) Field of Classification Search ..... 415/115; 416/96 R, 97 R
See application file for complete search history.

(56) References Cited

U.S. PATENT DOCUMENTS

| | | | | |
|---|---|---|---|---|
| 5,165,852 | A | 11/1992 | Lee et al. | |
| 5,356,265 | A | 10/1994 | Kercher | |
| 5,538,394 | A * | 7/1996 | Inomata et al. | 416/97 R |
| 5,660,524 | A | 8/1997 | Lee et al. | |
| 5,813,835 | A | 9/1998 | Corsmeier et al. | |
| 5,931,638 | A | 8/1999 | Krause et al. | |
| 6,019,579 | A * | 2/2000 | Fukuno et al. | 416/97 R |
| 6,129,515 | A | 10/2000 | Soechting et al. | |
| 6,168,381 | B1 | 1/2001 | Reddy | |
| 6,273,682 | B1 | 8/2001 | Lee | |
| 6,544,001 | B2 | 4/2003 | Dailey | |
| 6,595,748 | B2 | 7/2003 | Fodman et al. | |
| 6,705,836 | B2 | 3/2004 | Bourriaud et al. | |
| 6,805,535 | B2 * | 10/2004 | Tiemann | 416/233 |
| 6,916,155 | B2 | 7/2005 | Eneau et al. | |
| 7,014,424 | B2 | 3/2006 | Cunha et al. | |

* cited by examiner

*Primary Examiner*—Ninh H Nguyen
(74) *Attorney, Agent, or Firm*—John Ryznic

(57) ABSTRACT

A turbine blade with four separate cooling circuits is disclosed. A leading edge cooling circuit, a trailing edge cooling circuit, a three-pass serpentine cooling circuit on the pressure side, and a five-pass serpentine cooling circuit on the suction side provide maximum cooling with a minimum air flow through the blade. The pressure side serpentine circuit flows from leading edge side to trailing edge side, while the suction side serpentine circuit flows from trailing edge side to leading edge side in order to prevent a separation rib or wall between the two serpentine circuits from being overcooled. The separate cooling circuits can be individually regulated to provide efficient use of cooling air flow and obtain a more even blade temperature to reduce thermal gradients and therefore internal stress levels.

8 Claims, 1 Drawing Sheet

COMPARTMENT COOLED TURBINE BLADE

BACKGROUND OF THE INVENTION

1. Field of the Invention

The present invention relates to fluid reaction surfaces, and more specifically to an air cooled turbine blade.

2. Description of the Related Art Including Information Disclosed Under 37 CFR 1.97 and 1.98

In a gas turbine engine, either an aero engine or an Industrial Gas Turbine (IGT), a compressor supplies compressed air into a combustor to be mixed with a fuel and burned to produce a hot gas flow through the turbine of the engine. The hot gas flow passes through a multiple stage turbine having a plurality of stationary vane or nozzle stages with an equal number of rotating blade stages arranged in an alternating manner. The turbine progressively reduced the hot gas flow temperature by removing mechanical energy from the flow.

One method of increasing the efficiency of the engine is to provide for a higher entry temperature into the turbine. However, the material properties of the first stage vane and blades have temperature limits for use. In order to increase the turbine inlet temperature, internal cooling of the vanes and blades have been used which allow for higher temperatures, and therefore increased efficiency.

The compressed air used to pass through the internal parts of these vanes and blades is usually bled off from the compressor, which reduces the amount of compressed air in which the engine has performed work thereon that is not used in the combustor. This bleed off air from the compressor also reduces the efficiency of the engine. It is thereof an object of designers of air cooled turbine vanes and blades to provide increased cooling of these turbine members while making use of minimum amounts of compressed air in order to improve the engine efficiency.

In order to cool a turbine airfoil in the prior art, cooling air is passed through an internal cooling circuit. An example of this is disclosed in U.S. Pat. No. 6,544,001 B2 issued to Dailey on Apr. 8, 2003 entitled GAS TURBINE ENGINE SYSTEM in which an airfoil includes a single hollow portion that forms an internal cooling air passage. A plurality of cooling holes discharges cooling air from the hollow portion to the external surface of the airfoil. One major problem with this type of cooling circuit is that a single pass through the airfoil is used, and therefore heat transfer to the cooling air is minimal. Another problem is that the pressure side cooling holes require higher pressure to discharge to the external surface than does the cooling holes of the suction side. In this patent, the air pressure in the hollow portion must be high enough to discharge enough cooling air onto the pressure side, resulting in excess amount of cooling air to be discharged through the suction side cooling holes. Cooling air is wasted, resulting in lower engine efficiency.

To provide for a longer cooling air flow path within an airfoil, the prior art made use of a serpentine cooling flow circuit. U.S. Pat. No. 7,014,424 B2 issued to Cunha et al on Mar. 21, 2006 entitled TURBINE ELEMENT discloses a turbine airfoil with three separated cooling circuit within the airfoil. A first cooling circuit is located in the leading edge portion and discharges cooling air from a channel into a showerhead arrangement to cool the leading edge. A five-pass serpentine circuit is located at the mid-region of the airfoil. Cooling air is supplies in the first leg of the five-pass serpentine circuit and flows upward from root to tip in order that the fifth leg also flows upward in the airfoil to discharge into the airfoil tip. A third separate cooling circuit is located in the trailing edge region. One problem with the cooling circuit of the Cunha et al patent is that the five-pass serpentine circuit is used to cool both the pressure side wall and the suction side wall. In order to provide adequate cooling for the hotter pressure side wall, higher pressure is required and more cooling than is required is used on the suction side wall. Also, the second and fourth legs of the serpentine circuit supply cooling air to cooling holes on both sides of the airfoil. This also results in over-pressure for the suction side and a waste of cooling air discharged onto the suction side. Lower engine efficiency is a result.

To improve on the cooling circuit like the one shown in the Cunha et al patent, some prior art make use of two serpentine circuits at the mid section of the airfoil. U.S. Pat. No. 5,813,835 issued to Corsmeier et al on Sep. 29, 1998 entitled AIR-COOLED TURBINE BLADE shows a prior art cooling circuit (FIG. 3*a* in this patent) that has a three-pass serpentine circuit on the pressure side and another three-pass circuit on the suction side opposite to the circuit on the pressure side. A divider wall (212 in this patent) separates the two serpentine circuits. The improvement in this cooling circuit is that the suction side serpentine cooling circuit can operate at a lower pressure than the pressure side serpentine circuit, thus requiring less cooling flow to be wasted and therefore improving the engine efficiency. On problem with this cooling circuit is that the both serpentine cooling circuit flow through the passages from the leading edge toward the trailing edge. The Corsmeier et al patent is an improvement to this circuit, in which a third middle cooling circuit is added and positioned between the pressure and suction side cooling circuits. The reason for this is that the divider wall of the prior art cooling circuit tends to be overcooled by the flow of cooling air passing through the serpentine flow passages that surround the divider wall. If the middle portion of the airfoil is overcooled, then thermal gradients occur within the airfoil and produce undesired stress levels. in the Corsmeier et al patent, the flow path of both mid-airfoil serpentine circuit is from trailing edge toward the leading edge. Cooling air is wasted in the pressure side serpentine circuit because of this. The highest pressure acting on the pressure side is near the forward most leg of the pressure side serpentine circuit. The cooling air must flow through the first and second legs of the serpentine circuit in order to reach the third leg and be discharged out through the cooling hole to cool the hottest section of the pressure side wall. Thus, an overpressure is required to supply an adequate amount of cooling air at the necessary pressure for this cooling hole.

The U.S. Pat. No. 6,705,836 B2 issued to Bourriaud et al on Mar. 16, 2004 entitled GAS TURBINE BLADE COOLING CIRCUITS discloses a turbine blade cooling circuit having five independent cooling circuits within the blade (labeled A through E in this patent). Circuit A is a three-pass serpentine circuit on the pressure side and flows in a direction from back to front of the airfoil. Circuit B is a three-pass circuit with two first legs and flows in a back to front direction, opposite to the pressure side serpentine circuit. Circuit C is a leading edge circuit, Circuit D is a trailing portion circuit, and Circuit E cools the trailed edge. The cooling circuits of the Bourriaud et al patent are a near-wall cooling design. A central cavity (6 in this patent) is positioned between the pressure and suction side cooling circuits, and supplies cooling air to the leading edge cavity (* in this patent) of the leading edge cooling circuit C. because of the central cavity, the inner walls of the airfoil are also overcooled as in the above divider wall described in the Corsmeier et al patent. Therefore, thermal gradients occur within the blade and result in undesirable stresses.

It is therefore an object of the present invention to provide for an internal cooling circuit for a turbine airfoil that provides adequate cooling, minimal cooling flow, and provides for a more even temperature distribution throughout the airfoil to reduce stress levels from a thermal gradient.

BRIEF SUMMARY OF THE INVENTION

A turbine airfoil with serpentine blade cooling passages is divided up into four compartments that include a blade leading edge region, a blade pressure side section, a blade suction side section, and a blade trailing edge region. Each of the four compartments is fluidly separate from the others in that one circuit does not corn into fluid communication with another circuit within the blade. The leading edge region includes a supply channel in communication with a showerhead cooling arrangement, the pressure side section includes a triple pass parallel flow circuit, the suction side section includes a five pass counter flow circuit, and the trailing region includes a multiple cavity and metering hole flow circuit. The turbine airfoil having the four different compartments for different zones eliminates the blade back flow margin (BFM) and cooling flow mal-distribution problem, increases the cooling design flexibility, and minimizes cooling scheme sensitivity due to geometry and mainstream variations.

The serpentine blade cooling design of the present invention compartmentalizes the blade into four zones: a leading edge region, a pressure side section, a suction side section, and a trailing edge region. Each individual cooling zone can be independently designed based on the local heat load and aerodynamic pressure loading conditions. Compartmentalizing the blade into four different zones increases the design flexibility to re-distribute cooling flow and/or add cooling flow to each zone, therefore increasing growth potential for the cooling design. The pressure side flow circuit is separated from the suction side flow circuit, and therefore eliminates the blade mid-chord cooling flow mal-distribution due to film cooling flow mal-distribution, film cooling hole size, and mainstream pressure variation. The pressure side flow circuit is separated from suction side flow circuit, and therefore eliminates design issues such as back flow margin (BFM) and high blowing ration for the blade suction side film cooling holes. The mid-chord serpentine flow circuits can be designed as counter flow to each other. This yields a more uniform temperature distribution for the airfoil mid-chord section. For the current cooling concept, the pressure side is a triple pass parallel flow circuit and the suction side is a five-pass counter flow circuit. Separating the blade mid-chord serpentine flow circuits eliminates flow variations between pressure and suction side flow split within a cooling flow cavity.

DETAILED DESCRIPTION OF THE INVENTION

Figure 1:
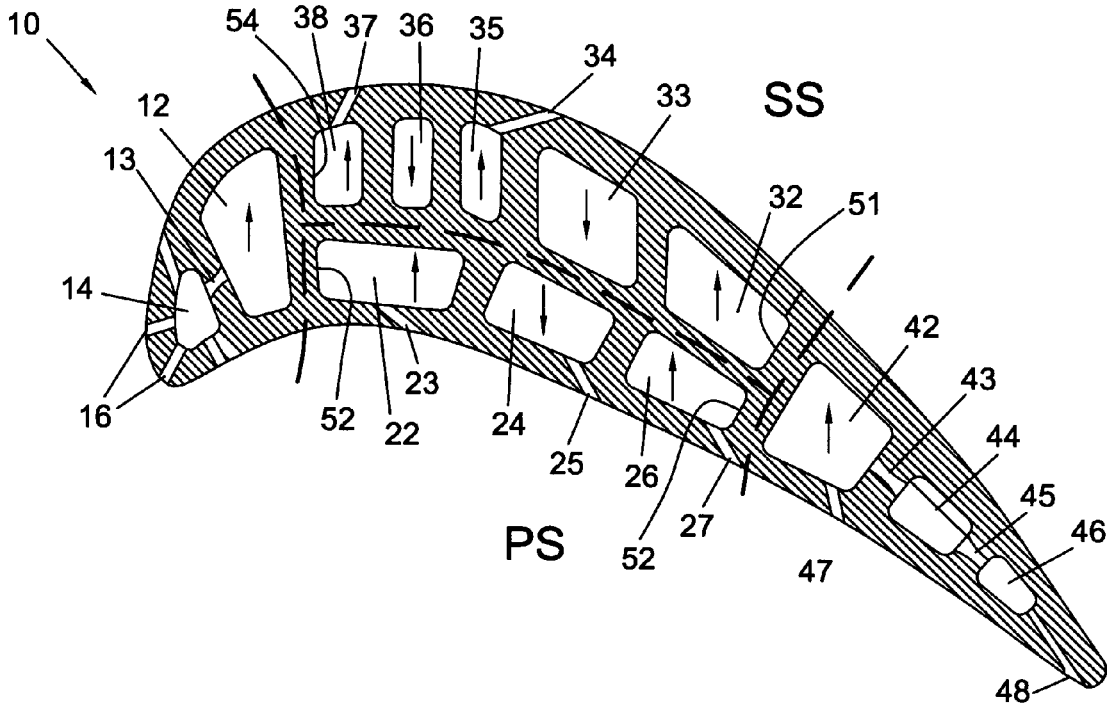
FIG. 1 shows a cross section view of a turbine airfoil having the four separated cooling compartment zones.

The present invention is an airfoil used in a turbine that requires cooling fluid to flow through internal passages formed within the airfoil body. The airfoil can be a rotating blade or a stationary vane or nozzle. FIG. 1 show the airfoil 10 divided up into four compartments or zones. The first compartment is the leading edge region that includes a supply channel 12 and a showerhead passage 14 connected by a plurality of metering holes 13. The showerhead passage 14 can be a single passage extending from the root to the tip of the airfoil, or a plurality of passages separated from each other, but each connected to the supply channel by one or more metering holes 13. Extending out from the showerhead passage 14 is a plurality of film cooling holes 16 used to provide film cooling for the leading edge or first compartment of the airfoil 10.

A second compartment of the airfoil cooling invention is the pressure side section that includes a three pass serpentine flow circuit. A supply channel 22 forms the first leg of the three pass serpentine circuit, and includes a plurality of film cooling holes 23 to supply cooling air to the pressure side surface of the airfoil. A second leg 24 and third leg 26 of the serpentine flow cooling circuit is connected downstream from the first leg. The second leg passage 24 includes a plurality of film cooling holes 25, while the third leg passage 26 includes a plurality of film cooling holes 27 both of which provide cooling air to the pressure side surface of the airfoil. Cooling air is supplied from an external source (external to the airfoil body) to the first leg passage 22 of the three pass serpentine flow cooling circuit of the second compartment. A left side wall 53 of the supply channel 22 is located adjacent to the supply channel 12 of the leading edge cooling circuit. a right side wall 52 of the third leg 26 is located adjacent to the supply channel 42 for the trailing edge circuit to be described below.

A third compartment of the airfoil cooling invention is the suction side section and includes a five-pass serpentine flow cooling circuit. this five-pass serpentine circuit includes a first leg 32, a second leg 33, a third leg 35 with a film cooling hole 34, a fourth leg 36, and a fifth leg 38 with a film cooling hole 37. An airfoil tip cooling hole could be used to discharge cooling air from the fifth leg passage 32 onto the airfoil tip for cooling thereof. Cooling air is supplied from an external source to the bottom of the first leg 32 and flows toward the fifth leg 37 and discharges cooling air onto the tip region of the airfoil. A left side wall 54 of the fifth leg 38 of the five-pass circuit is located adjacent to the supply channel 12 of the leading edge circuit. The left side wall 54 of the five-pass circuit is substantially aligned with the left side wall 53 of the three-pass circuit in the chordwise length of the blade. A right side wall 51 of the first leg 32 of the fiver-pass circuit is adjacent to the supply channel 42 of the trailing edge cooling circuit. The right side wall 51 of the five-pass circuit is substantially aligned with the right side wall 52 of the three-pass circuit in the chordwise length of the blade. Thus, the three-pass cooling circuit and the five-pass cooling circuit have substantially the same chordwise length along the blade from the leading edge cooling circuit to the trailing edge cooling circuit. The third leg 35, the fourth leg 36, and the fifth leg 38 of the five-pass circuit have cross sectional areas of about ½ that of either the first 32 or second 33 legs as seen in FIG. 1.

The fourth and last compartment of the airfoil cooling invention is the trailing edge region and includes a cooling air supply channel 42 having a plurality of film cooling holes 47, a first cavity 44 connected to the supply channel 42 by a plurality of metering holes 43, and a second cavity 46 connected to the first cavity 43 by a plurality of metering holes 45. A plurality of discharge holes 48 is connected to the second cavity 46 to supply cooling air to the trailing edge of the airfoil 10. Cooling air is supplied from an external source (external to the airfoil body) to the supply channel 42, through the metering holes and cavities, and then out the discharge or exit holes 48 to provide cooling for both the trailing edge portion of the blade.

The highest external pressure acting on the airfoil occurs near the cooling hole 23. Therefore, the pressure within the passage 22 must be higher than the other passages of this serpentine circuit. Therefore, the cooling air is supplied to the first leg 22 of the three-pass serpentine circuit on the pressure side first. The pressure side circuit flow toward the trailing edge such that the second leg 24 discharges cooling air through cooling hole 25 at a lower pressure than through the cooling hole 23. The third leg 26 is at a still lower pressure and discharges through cooling hole 27. The external pressure on the pressure side decreases from the cooling hole 23 region moving along the pressure side towards the trailing edge. Thus, the present invention design provides adequate cooling of the pressure side while minimizing the amount of cooling air used.

The suction side uses a five-pass serpentine circuit that flows from the trailing edge region toward the leading edge region. No cooling holes on the suction side downstream from the second leg 33 are warranted. If cooling air was discharged at this location, it would disrupt the laminar flow over the suction side. The external pressure on the suction side is the highest near the cooling hole 34. therefore, by providing the five-pass serpentine circuit to flow toward the leading edge will provide for the third leg 35 to have a higher pressure than the fifth leg 38 such that more pressure is available in the third leg 35 to discharge adequate cooling air through the cooling hole 34 without discharging too much through the cooling hole 37 in the fifth leg 38. this arrangement also prevents the shared wall between the pressure side three-pass circuit and the suction side five-pass circuit from being cooled to much such that the prior art thermal gradients are formed and the stress levels too high. The airfoil of the present invention maintains a more uniform temperature distribution than the above cited prior art references without using too much cooling air.

The cooling circuit arrangement of the present invention uses a five-pass serpentine circuit on the suction side because the five-pass circuit provides more heat transfer than and requires less pressure than does the three-pass circuit. The five-pass circuit on the suction side transfers more heat to the shared wall. The three-pass circuit on the pressure side provides enough pressure to discharge cooling air through the cooling holes 23, 25, and 27 from the three legs.

The benefits of the four compartment airfoil include the following. Each individual cooling compartment or zone can be independently designed based on the local heat load and aerodynamic pressure loading conditions. Dividing the airfoil into four compartments increases the design flexibility to re-distribute cooling glow and/or add cooling flow for each zone, and therefore increasing the growth potential for the cooling design. The pressure side flow circuit is separated from the suction side flow circuit, and therefore eliminates the blade mid-chord cooling glow mal-distribution due to film cooling flow mal-distribution, film cooling hole size, and mainstream pressure variation. The pressure side flow circuit is separated from suction side flow circuit, and therefore eliminates design issues such as the back flow margin (BFM) and high blowing ratio for the blade suction side film cooling holes. The mid-chord serpentine flow circuits can be designed as counter flow to each other. This yields a more uniform temperature distribution for the airfoil mid-chord section. For the present invention, the pressure side is a three pass parallel flow circuit while the suction side is a five pass counter flow circuit. Separation blade mid-chord serpentine flow circuits eliminate flow variation between pressure and suction side flow split within a cooling flow cavity.

I claim the following:

1. A turbine blade having a leading edge and a trailing edge, a pressure side and a suction side, and an internal cooling circuit to provide cooling for the blade, the blade comprising:

A leading edge cooling circuit to provide cooling air to cool the leading edge portion of the blade;

A trailing edge cooling circuit to provide cooling air to cool the trailing edge portion of the blade;

A three-pass serpentine cooling circuit on the pressure side of the blade and located between the leading edge cooling circuit and the trailing edge cooling circuit, the first leg of the three-pass circuit being located adjacent to the leading edge cooling circuit, each of the three legs including a cooling hole to discharge cooling air onto the pressure side surface of the blade;

A five-pass serpentine cooling circuit on the suction side of the blade and located between the leading edge cooling circuit and the trailing edge cooling circuit, the first leg of the five-pass circuit being located adjacent to the trailing edge cooling circuit, the third leg and the fifth leg each having a cooling hole therein to discharge cooling air onto the suction side surface of the blade; and, The four cooling circuits are not in fluid communication with each other within the blade.

2. The turbine blade of claim 1, and further comprising:

A divider rib separating the three-pass circuit from the five-pass circuit.

3. The turbine blade of claim 1, and further comprising:

The left-most sidewall of the first leg of the three-pass circuit is substantially aligned in the blade chordwise length to a left-most sidewall of the fifth leg of the five-pass circuit.

4. The turbine blade of claim 3, and further comprising:

A right-most sidewall of the third leg of the three-pass circuit is substantially aligned in the blade chordwise length to a right-most sidewall of the first leg of the five-pass circuit.

5. The turbine blade of claim 1, and further comprising:

The trailing edge cooling circuit includes a cooling air supply channel located adjacent to the three-pass circuit and the five-pass circuit, the trailing edge cooling circuit including at least one trailing edge cavity with a metering hole to provide fluid communication to the supply channel, the at least one trailing edge cavity including an exit hole to discharge cooling air from the blade.

6. The turbine blade of claim 5, and further comprising:

The cooling air supply channel includes at least one film cooling hole opening onto the pressure side of the blade to discharge cooling air from the channel to the pressure side of the blade.

7. The turbine blade of claim 1, and further comprising:

The leading edge cooling circuit includes a cooling air supply channel located adjacent to the three-pass circuit and five-pass circuit, a leading edge cavity in fluid communication with the cooling air supply channel through at least one metering hole, and a showerhead arrangement in fluid communication with the leading edge cavity to provide film cooling to the leading edge of the blade.

8. The turbine blade of claim 1, and further comprising:

The third leg, the fourth leg, and the fifth leg each have about one half the cross sectional area of the first or second legs of the of the five-pass cooling circuit.

* * * * *